US007336041B2

(12) United States Patent
Ayala et al.

(10) Patent No.: US 7,336,041 B2
(45) Date of Patent: Feb. 26, 2008

(54) AUTOMATIC LIGHT DIMMER FOR ELECTRONIC AND MAGNETIC BALLASTS (FLUORESCENT OR HID)

(76) Inventors: Vicente Aldape Ayala, Argentina 3916, Col. Desarolla Las Torres 91, Monterrey, N.L. 64760 (MX); Ricardo Alejandro Lopez Guajardo, Via Centauro 5030-2 Cumbres Condocasa, Monterrey, Nuevo Leon 64610 (MX)

( * ) Notice: Subject to any disclaimer, the term of this patent is extended or adjusted under 35 U.S.C. 154(b) by 0 days.

(21) Appl. No.: 11/259,801

(22) Filed: Oct. 27, 2005

(65) Prior Publication Data

US 2006/0119288 A1 Jun. 8, 2006

Related U.S. Application Data

(60) Provisional application No. 60/633,751, filed on Dec. 6, 2004.

(51) Int. Cl.
*H05B 37/02* (2006.01)

(52) U.S. Cl. ..... 315/291; 315/307; 315/DIG. 4

(58) Field of Classification Search ..... 315/209 R, 315/172, 173, 291, 307, 312–315, 225, DIG. 4
See application file for complete search history.

(56) References Cited

U.S. PATENT DOCUMENTS

| | | | | |
|---|---|---|---|---|
| 5,729,097 | A * | 3/1998 | Holzer | 315/307 |
| 6,046,550 | A * | 4/2000 | Ference et al. | 315/291 |
| 6,147,462 | A * | 11/2000 | Sing et al. | 315/307 |
| 6,172,466 | B1 | 1/2001 | Hi et al. | |
| 6,188,181 | B1 * | 2/2001 | Sinha et al. | 315/293 |
| 6,870,329 | B2 * | 3/2005 | Krieger et al. | 315/295 |

* cited by examiner

*Primary Examiner*—Douglas W. Owens
*Assistant Examiner*—Jimmy Vu
(74) *Attorney, Agent, or Firm*—Jackson Walker, L.L.P.; William B. Nash; Mark H. Miller

(57) ABSTRACT

An apparatus is disclosed for automatic light dimming of electronic and magnetic ballasts used for fluorescent or high intensity discharge lamps. A variable capacitant's limiting current is added in the lamps which provides lighting intensity controls without changing the ballast's operation frequency. Several capacitors are placed in line with a terminal for the lamp. The capacitor's switching capability is used to change the current received by the lamp. The amount of voltage can be controlled by either varying the supply voltage, or with an elimination sensor, or by manual potentiometer control.

10 Claims, 9 Drawing Sheets

Figura 3: Temperatur coeffecient Y5V class 2 capacitors ( operating temperature range: -25°C +85°C )

ACCESSORY TO ILLUNINATION SENSOR CONTROL OF LIGHTING

ACCESSORY TO VOLTAGE SUPPLY CONTROL ILLUMINATION

AUTOMATIC LIGHT DIMMER FOR ELECTRONIC AND MAGNETIC BALLASTS (FLUORESCENT OR HID)

This patent application claims priority from Provisional Application No. 60/633,751 filed Dec. 6, 2004 and incorporated by reference the '751 application as if it were fully printed herein.

FIELD OF THE INVENTION

This invention is related to the electronic and magnetic ballasts for fluorescent or high intensity discharge ("HID") lamps with illumination control.

BACKGROUND OF THE INVENTION

Fluorescent lamps using electronic ballasts are very popular in lighting, especially in offices, the work place, businesses and homes, while HID lamps are normally used in public lighting or large open spaces such as storage rooms, parking lots, etc. In the latter, electronic ballasts are starting to appear on the market given certain technical advantages against the electromagnetic ballasts.

Ballasts use electromagnetic and electronic technologies. The latter technique works by means of a solid-state switched-source system that, with working frequencies of more than 10,000 cycles per second, achieves better lux per watts yields and assures longer life of the lamps, with a high power factor.

PRIOR ART

A number of approaches have been taken to control the light intensity of a fluorescent lamp or a HID lamp. Some have used pulse width modulation of the inverter driver, or by changing the supply AC voltage to the rectifying circuit which supplies the DC voltage to the inverter.

For example, some use a phase controlled dimmable ballast for a fluorescent lamp. In this approach a small portion of the phase of the input supply voltage is removed, and the precise amount of phase removed is used to generate a switching signal that controls the frequency of the electronic ballast and thus the light output.

In another version of an automatic light dimmer for gas discharge lamps, when the lights are to be turned on the apparatus applies full power to the primaries of the lamp ballasts for a pre-selected time period thus ensuring all the lamps in the system are lit. After the pre-selected time period has passed, the apparatus automatically dims the lamps and maintains them in the dimmed state.

There are electronic ballasts with illumination control, such as U.S. Pat. No. 6,172,466 B1, known as phase-control dimmable ballast, which, unlike the present invention, reduces a portion of the supply voltage in each half cycle; with this, a circuit interprets the selected illumination level, affecting the conduction times in the solid-state switching system; this process affects the power factor of the ballast and contributes a degree of harmonic distortion to the power line. This system, which interacts with internal elements of the electronic ballast, cannot be built as an element that is external to the ballast because it requires structural changes in the system of common electronic ballasts.

Also well-known are the electronic ballasts that have a certain number of options in their terminals, where the power is connected, in the option that corresponds to a lighting intensity. With this system, the different lighting options can be wired to a multiple switch; the disadvantage is that the lighting changes suddenly and cables must be added to the lighting circuit. The change in the illumination level is based on a circuit that, like the previous technique described, affects the conduction times in the solid-state switching system.

Even with these ballasts, patents and the patents cited in them there still remains a need for a simple and reliable means for providing dimming control for electronic and magnetic ballasts for fluorescent or HID lamps and which overcomes or at least minimizes many of the previously mentioned problems.

SUMMARY OF THE INVENTION

It is an object of the present invention to control the lighting level in electronic and magnetic ballasts for fluorescent and HID (e.g., high pressure sodium, metal halide and mercury) lamps. This is accomplished by adding a variable capacitance limiting current in the lamps which provides lighting intensity control without changing the ballast operation frequency. Capacitors are used for this purpose, which due to the arrangement in this system provide a variable capacity, in line with a terminal of the lamp or lamps.

The technique utilized to change the capacitance of these elements is based on the switching of several capacitors. This switching changes the total capacitance value which changes the current received by the lamp or lamps. The switching can be pre-selected to be done slowly or fastly depending on the specific application. The changing of the capacitance can also be done by taking advantage of the thermal characteristic of certain capacitors, which by submitting them to controlled heat, achieves softened changes in its values, as well as in the selected lighting.

It is another object of the present invention to provide additional controlling characteristics to electronic and magnetic ballasts, whereby such ballasts can be controlled by either varying the supply voltage, or with an illumination sensor, or by a manual potentiometer control. The first option is accomplished by varying the supply voltage within the specified range of the ballast (which normally extends to more than 25% of the minimum operating voltage) so that the accessory interprets the degree of lighting desired. The value of the variable capacitor changes depending on the supply voltage of the ballast, reducing the current that flows through the lamp and the resulting lighting level. Another method to control this accessory is providing either an illumination sensor or a manual potentiometer so that the accessory interprets the degree of lighting desired.

It is a further object of the present invention to provide a control illumination level apparatus that applies full power to the lamp or lamps upon starting or momentary power interruption with no dependence upon the control level or the applied load or length of interruption.

It is a further object of the present invention to provide a control illumination level apparatus that applies full power and in reduction level mode at an industry accepted high power factor without introducing harmonics to the system.

Due to the fact that most commonly installed electronic and magnetic ballasts represent a high percentage of current applications, and their minimal cost due to marketing and variety of manufacturers, the use of this invention has become more beneficial, requires the least amount of additional components, and offers cost advantages and easy installation that achieve illumination control and energy savings.

SOME OF THE ADVANTAGES OBTAINED WITH THIS INVENTION ARE:

This invention adds control characteristics to standard magnetic or electronic ballast which provides an ability to select an illumination level.

Lower investment to adopt an energy savings control system in an existing lighting circuit, with commonly used electronic or magnetic ballasts, due to the fact that the cost of this invention is considerably less than the option of an electronic ballast with an integrated dimming control.

The invention takes advantage of the convenient and competitive prices, quality and service of current market offer of standard electronic and magnetic ballasts.

The use of the present invention does not change the high power factor of electronic ballasts.

The use of the present invention does not provide additional harmonic distortion.

This invention does not require installation of additional cable for illumination control.

The elements used in this invention have better performance to withstand peaks in current and voltage than that of switching elements in electronic ballasts with illumination control.

This invention can reduce lighting softly, that is, gradually or in reduction steps.

The present invention starts the lamp without any illumination reduction so as to warm the lamps an appropriate amount of time before starting any illumination reduction. The specific warming time will vary per lamp manufacturer's recommendations for the specific lamp.

BRIEF DESCRIPTION OF DRAWINGS

An embodiment of the invention will now be described by way of example and with reference to the accompanying drawings, in which.

DETAILED DESCRIPTION OF PREFERRED EMBODIMENT

Figure 1:
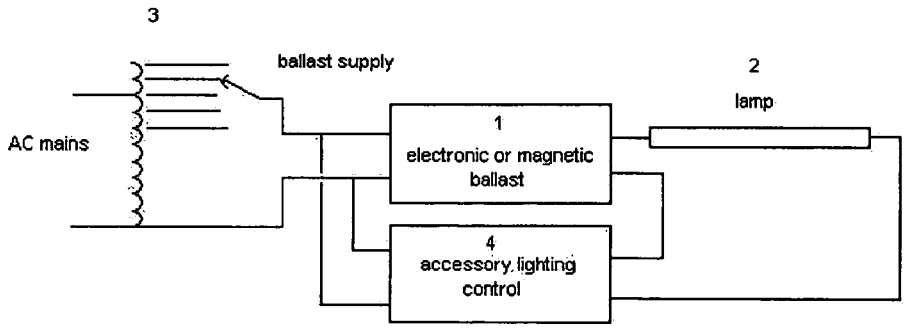
FIG. 1 is a component connection diagram of an embodiment of the present invention.

Referring to FIG. 1, a component connection diagram is shown for a lighting intensity control in accordance with the present invention. An electronic or magnetic ballast unit 1, a fluorescent lamp unit 2, a voltage controlled supplier unit 3, and an intensity level control accessory unit 4 incorporating the present invention.

The voltage controlled supplier unit 3 is located between the alternating current ("AC") mains and the electronic or magnetic ballast unit 1, the intensity level control accessory unit 4 is connected to the voltage controlled output unit 3, also connected a terminal lamp unit 2 and terminal ballast unit 1, this ballast line is usually connected to the lamp unit 2.

The element to supply the controlled voltage (unit 3) usually uses an autotransformer (or variac) with a number of voltage outputs that are selected according to the desired voltage on the output to supply the voltage of the electronic or magnetic ballast.

Figure 2:
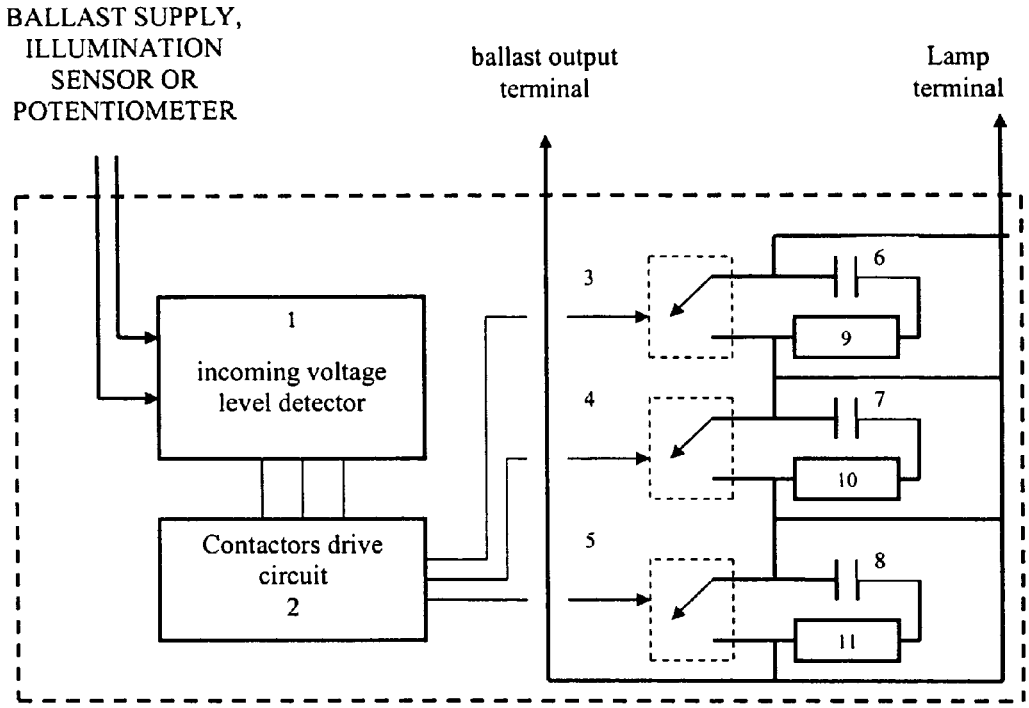
FIG. 2 is a component diagram of an embodiment of the present invention.

FIG. 2 describes the intensity level control accessory unit for controlling the illumination in accordance with the present invention. The input voltage may be used with a supply voltage, an illumination sensor or potentiometer control, as control voltage, feeding the input of the voltage level detector unit 1 and this activates the contactor drivers unit 2. This description refers to a device with three intensity selection levels but it could be set according to the application requirements. In other words, the number of steps or selection levels could be more or less than three depending on the requirements of the specific application. The time period between the changes can also vary. Currently it is expected to be approximately one minute.

Each contactor unit 3, 4 and 5 is connected to a capacitor unit 6, 7 and 8. Each one of these capacitors has a value that opposes to a certain degree the current that flows through the lamp which has as a consequence an intensity reduction of the light of the lamp.

The capacitor units' equivalent capacity depends of the state of the contactors (units 3, 4 and 5) with direct relation to illumination level.

Each capacitor unit 6, 7 and 8 is connected with a resistor unit 9, 10 and 11 found near each capacitor. The resistor units have the function of elevating the temperature of the associated capacitor in a controlled way, that begins to raise its temperature based on the selection of the contactor (units 3, 4 and 5), changing the capacitor value as shown FIG. 3.

Figure 2A:
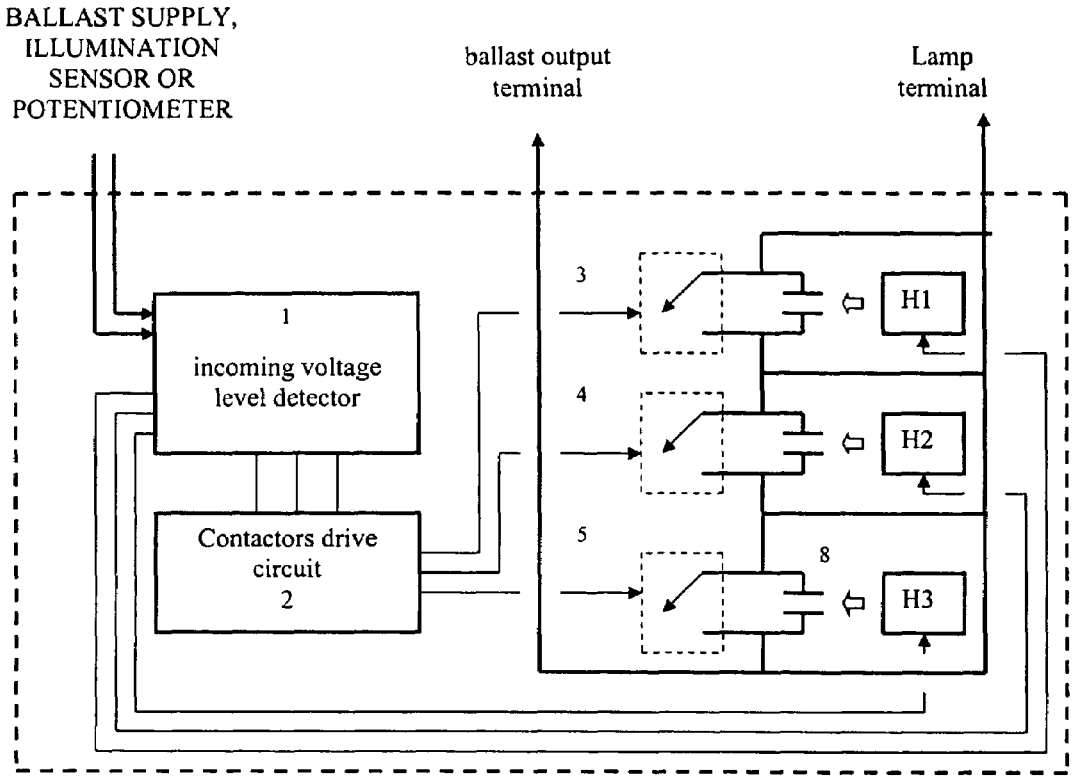
FIG. 2A is a component diagram of an alternate embodiment of the present invention.

Alternatively, another variant to heat the capacitor units 6, 7 and 8 is shown in FIG. 2A. In this embodiment, the resistor units 9, 10 and 11 are replaced with heating element units H1, H2 and H3. The heating element units are activated upon by the incoming voltage detector unit 1 in relation to the control voltage, making the correspondent capacity change in the capacitor units 6, 7 and 8 as a convenient change of illumination level.

Figure 3:
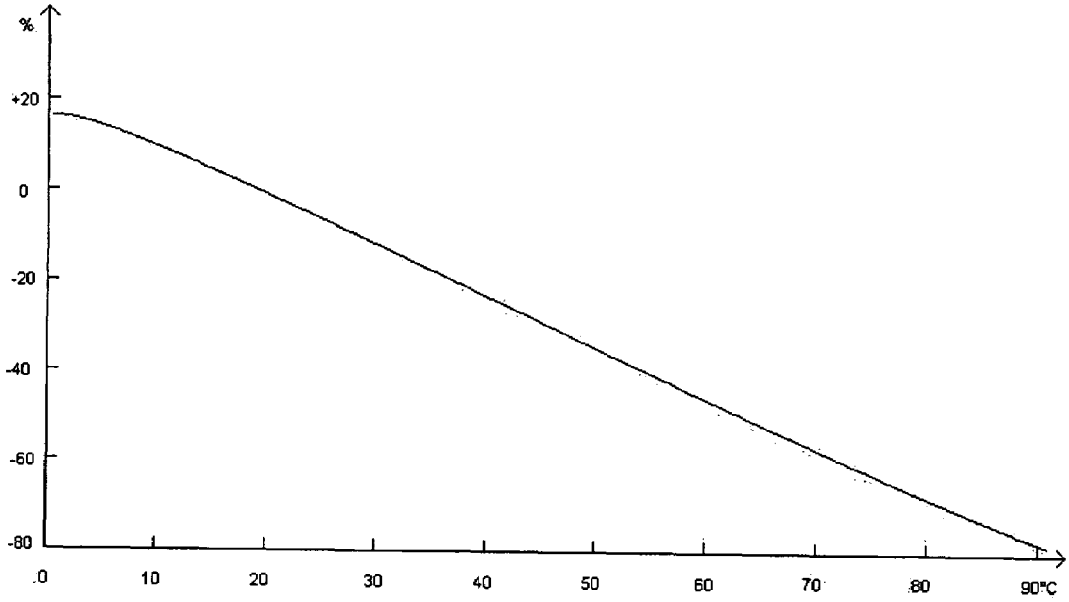
FIG. 3 is a chart illustrating the temperature coefficient of class 2 capacitors.

FIG. 3 describes a example of the behavior of certain capacitors (based on the class 2 capacitors Y5V) according to capacity value in function of the operative temperature in which it shows that for changes from 25° C. (78° F.) to 65° C. (130° F.) the variance of the value of its capacitance is approximately 50% lower, maintaining it far from its maximum operative temperature that in this case is 85° C., which means that when selecting one of the contactor units 3, 4 or 5 contactors, the selected reduction is done in a gradual form while the heating generated by resistor units 9, 10 or 11 FIG.

2. The values of this resistance are calculated according to the operative current and thermal conduction characteristic among its components.

Figure 4:
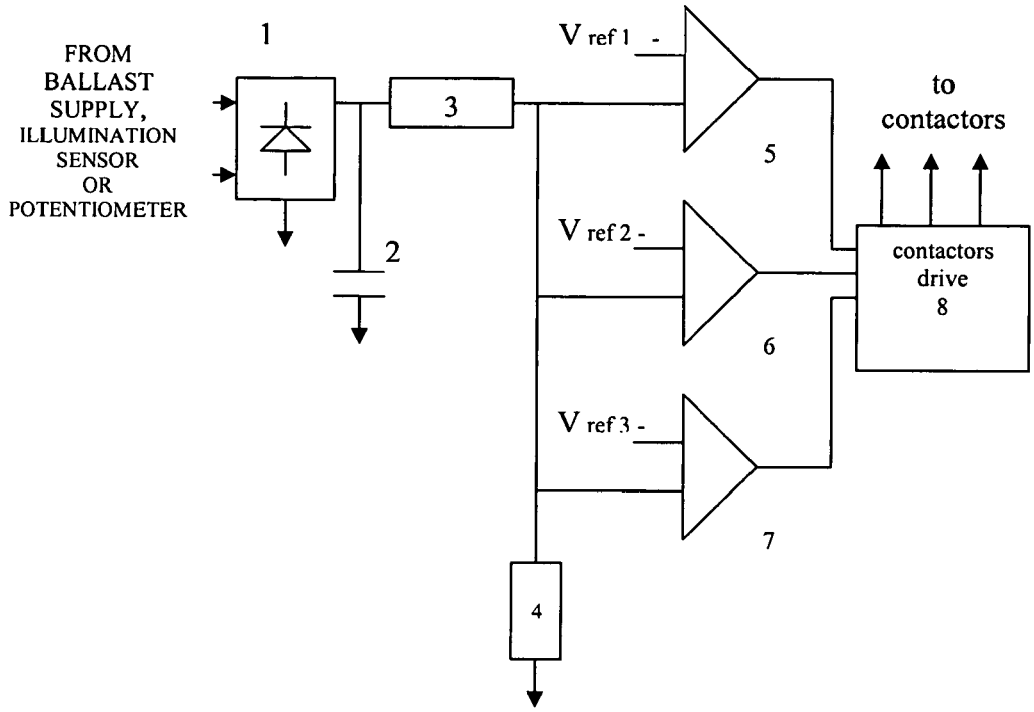
FIG. 4 is a circuit diagram of the incoming voltage level detector element of the invention shown in FIG. 2.

FIG. 4 illustrates the device that controls the illumination action on its detection section of the incoming voltage level detector 1 as shown in FIG. 2. The present embodiment refers to a device for a selection of three intensity levels, but the number of levels could vary. The endings are connected to the controlled voltage input (ballast supply, illumination sensor or potentiometer options), a normal process of converting the alternate current into direct current that is formed for a rectifier unit 1 and a filter unit 2 of FIG. 4. The direct current voltage is divided by means of the resistance shown on resistor units 3 and 4 to obtain the appropriate voltage level for the positive input of the voltage comparator's units 5, 6 and 7. These comparators do their function according to the reference voltage which is selected according to the input voltage level (ballast supply, illumination sensor or potentiometer) that would be used to obtain the level among its three levels.

EXAMPLE 1

Input Voltage=Ballast Supply

A. Condition to obtain a normal illumination where input voltage is from a ballast supply.

input voltage>selected voltage 1

The maximum input voltage is in function off the maximum operate ballast_voltage.

B. Condition to obtain an illumination with a minimum reduction (first reduction step) where input voltage is from a ballast supply.

input voltage<selected voltage 1 input voltage>selected voltage 2

Both conditions must be met.

C. Condition to obtain an illumination with a half reduction (second reduction step) where input voltage is from a ballast supply.

input voltage<selected voltage 2 input voltage>selected voltage 3

Both conditions must be met.

D. Condition to obtain an illumination with a maximum reduction (third reduction step) where input voltage is from a ballast supply.

input voltage<selected voltage 3

The minimum input voltage is in function off the minimum operate ballast voltage.

Alternatively, the input voltage can be determined by the use of an illumination sensor. In the illumination sensor, the output voltage of the illumination sensor is proportional to the ambient illumination level. As an example, if the ambient external light level is low so as to not add light in the desired area lit by luminaries, the illumination sensor output is low voltage (lower that the first reference voltage in the comparator units of the device). In this case the device interprets the degree of lighting desired and it will not reduce the light intensity of the lamps.

In the opposite situation, when the external lighting is so high that light is added to the desired area lit by luminaries then the device will reduce the light intensity of the lamps. The light intensity will be reduced in an amount such that the combined amount of light from ambient sources and the luminaries will equal the desired amount of light at the selected area.

EXAMPLE 2

Input Voltage=Voltage Illumination Sensor

A. Condition to obtain a normal illumination where the input voltage is from an illumination sensor.

input voltage<selected voltage 3

B. Condition to obtain an illumination with a minimum reduction (first reduction step) where the input voltage is from an illumination sensor.

input voltage>selected voltage 3 input voltage<selected voltage 2

Both conditions must be met.

C. Condition to obtain an illumination with a half reduction (second reduction step) where the input voltage is from an illumination sensor.

input voltage>selected voltage 2 input voltage<selected voltage 1

Both conditions must be met.

D. Condition to obtain an illumination with a maximum reduction (third reduction step) where the input voltage is from an illumination sensor.

input voltage>selected voltage 1

The following formulas can be used to select the values of R1 and R2 resistances as well as the reference voltage and selected voltage for the illumination control.

R1=component 4c resistance

R2=component 4d resistance

Selected voltage 1=V ref. $1/1.41*R2/(R1+R2)$

Selected voltage 2=V ref. $2/1.41*R2/(R1+R2)$

Selected voltage 3=V ref. $3/1.41*R2/(R1+R2)$

The unit 8 shows a drive circuit that acts a corresponding contactor to do the appropriate reduction according to the feeding voltage level.

In the case of usage of the ballast supply as voltage input, when the input voltage level is higher that the selected voltage 1, the outputs of the comparators will be as it is shown on Table 1. On the corresponding line and in this condition it is also shown the contactor that must activate this input output logic Table 1.

On the Table 1 it's shown the operation of the logic output for each control condition.

TABLE 1

| | Condición | | | | | |
|---|---|---|---|---|---|---|
| | Comp 1 | Comp 2 | Comp 3 | Cont. 1 | Cont. 2 | Cont. 3 |
| Vin > Vp1 | 1 | 1 | 1 | 1 | 1 | 1 |
| Vs1 > Vin > Vs2 | 0 | 1 | 1 | 0 | 1 | 1 |
| Vs2 > Vin > Vs3 | 0 | 0 | 1 | 0 | 0 | 1 |
| Vin < Vs3 | 0 | 0 | 0 | 0 | 0 | 0 |

In the case of using the illumination sensor as voltage input, when the input voltage level is higher that the selected voltage 1, the outputs of the comparators will be as it is shown on Table 2. On the corresponding line and in this condition it is also shown the contactor that must activate this input output logic Table 2.

On the Table 2 it's shown the operation of the logic output for each control condition.

TABLE 2

| | Condición | | | | | |
|---|---|---|---|---|---|---|
| | Comp 1 | Comp 2 | Comp 3 | Cont. 1 | Cont. 2 | Cont. 3 |
| Vin > Vp1 | 1 | 1 | 1 | 0 | 0 | 0 |
| Vs1 > Vin > Vs2 | 0 | 1 | 1 | 1 | 0 | 0 |
| Vs2 > Vin > Vs3 | 0 | 0 | 1 | 1 | 1 | 0 |
| Vin < Vs3 | 0 | 0 | 0 | 1 | 1 | 1 |

Figure 5:
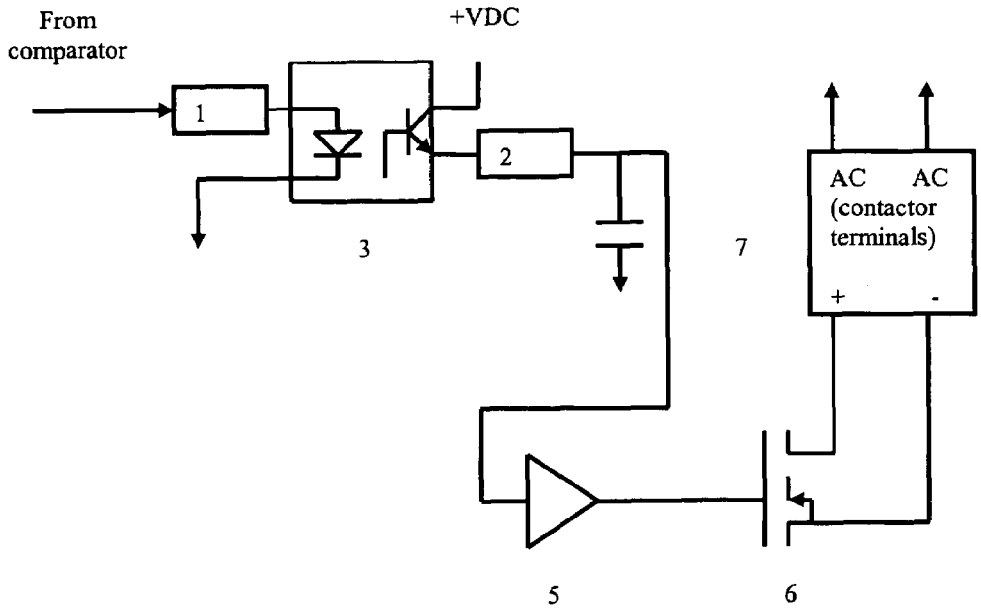
FIG. 5 is a circuit diagram of one of the three contactor drive elements for a CMOS contactor of the invention shown in FIG. 2.

Turning to FIG. 5 an embodiment is shown where the contactor drive diagram is CMOS contactor technology (unit 6), where the output comparators (described on the FIG. 4) feeding the optoisolator (unit 3), through resistance unit 1, thus charged the capacitor unit 4 in slow form in function of the resistance value unit 2. At the beginning of conduction an ascendant voltage ramp in the input amplifier unit 5, activates the contactor in a slow transition. A similar transition process takes place when the device is turned off.

Figure 6:
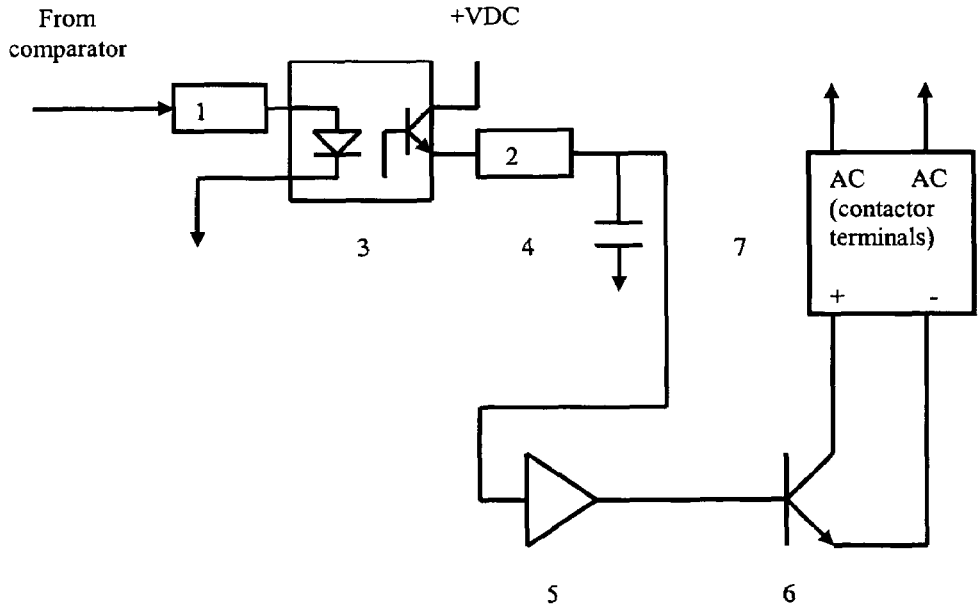
FIG. 6 is a circuit diagram of one of the three contactor drive elements for a bipolar transistor contactor of the invention shown in FIG. 2.

FIG. 6 shows an embodiment where the contactor drive diagram is a bipolar transistor contactor unit 6.

Figure 7:
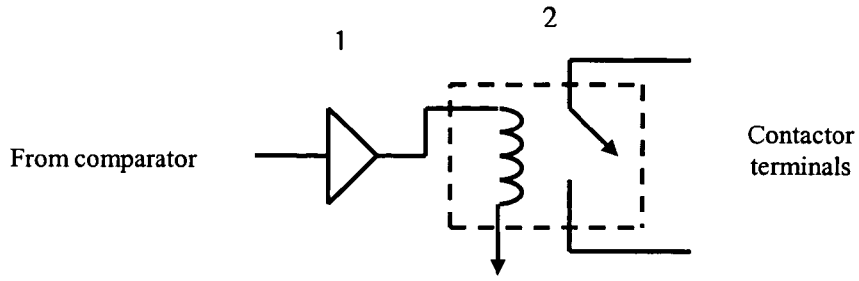
FIG. 7 is a circuit diagram of one of the three contactor drive elements for an electro mechanic contactor of the invention shown in FIG. 2.

FIG. 7 shows an embodiment where the contactor drive diagram is an electro mechanic contactor. The output compares signal from FIG. 4 is connected to input booster amplifier unit 1 to activate the electro mechanic contactor unit 2.

Figure 7A:
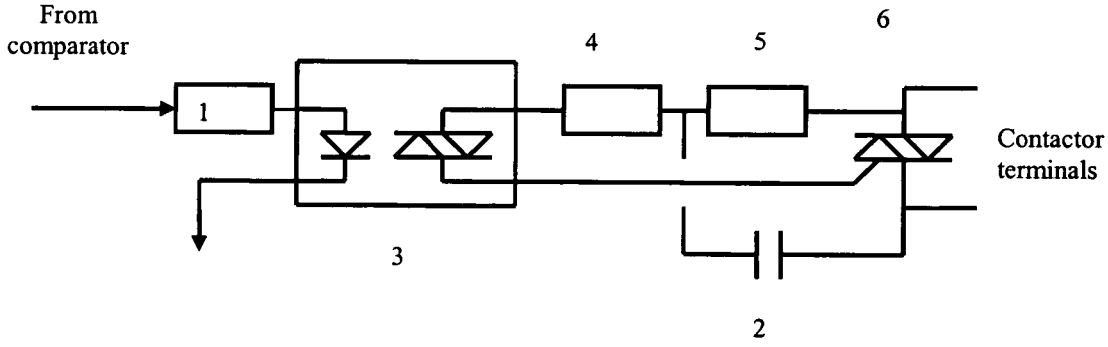
FIG. 7A is a circuit diagram of one of the three contactor drive elements for a thyristor contactor of the invention shown in FIG. 2.
Figure 8:
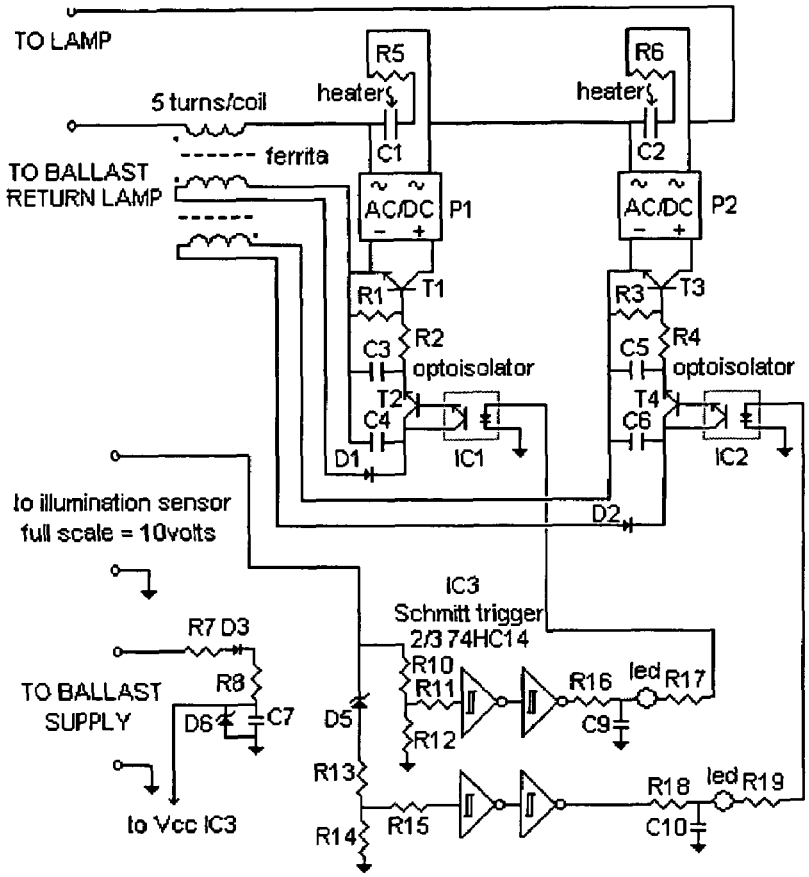
FIG. 8 is a circuit diagram of the invention shown in FIG. 2 using an illumination sensor to control the light intensity.
Figure 9:
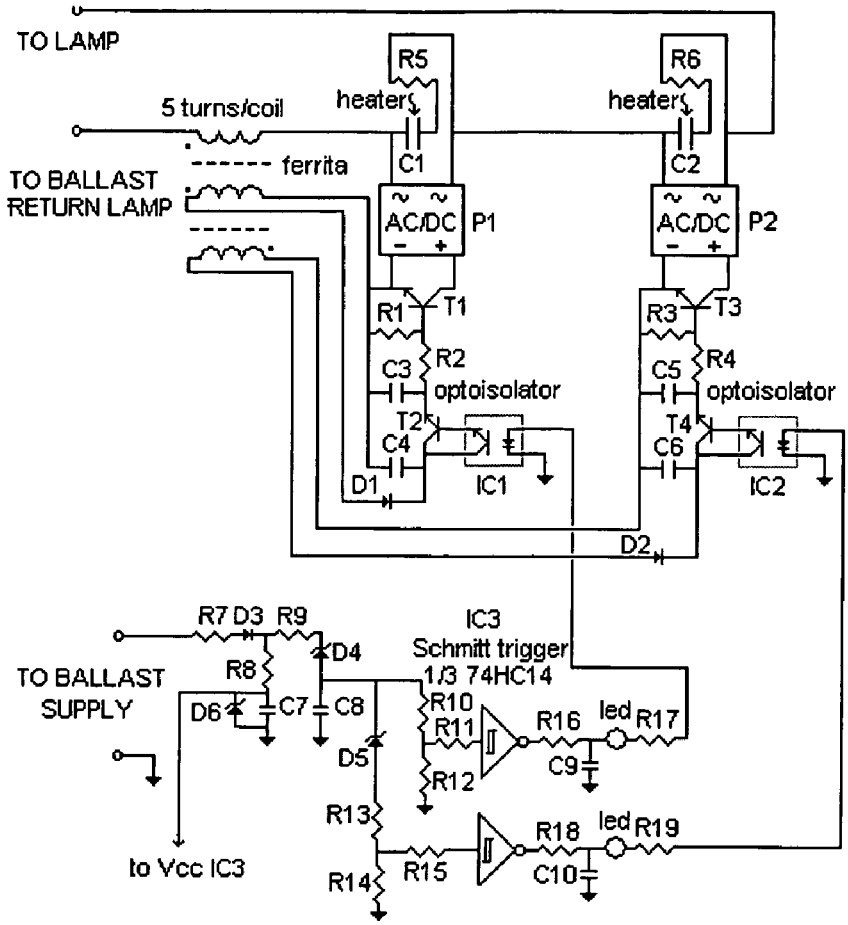
FIG. 9 is a circuit diagram of the invention shown in FIG. 2 using a voltage supply controller to control the light intensity.

The FIG. 7A shows an embodiment where the contactor drive diagram is an triac contactor unit 6, where the output comparers (described on the FIG. 4) feeding the optoisolator (unit 3), through resistance unit 1, thus charged the capacitor unit 2 through resistance unit 4. In conduction state a voltage in the capacitor unit 2, produce a current through resistance unit 5, activate the triac contactor unit 6.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is therefore contemplated that the appended claims will cover such modifications that fall within the scope of the invention.

The invention claimed is:

1. An apparatus for dimming a lamp so that a pre-selected amount of light is at a pre-selected location, comprising:

dimming control means for automatic or manual varying of the intensity of fluorescent or HID lamps so that the total amount of light at the pre-selected location is approximately the pre-selected amount of light without the use of dimming ballasts, said dimming control means comprising:

one or more capacitors that have heating elements that affect their capacitance, thus providing an electric current flow reduction to said lamp that allow said lamp's gradual light dimming characteristic to operate;

switching means to select between at least one of said one or more capacitors so as to vary equivalent capacitance thus providing a electric current flow reduction to said lamp that allow said lamp's gradual light dimming characteristic to operate; and switching means that by gradually changing the conductive resistance of a contactor for each of said one or more capacitors allows turning at least one of said one or more capacitors off and on causing said one or more capacitors to undertake a smooth transition from its on state to its off state that avoids the perception of abrupt changes in the lighting dimming process.

2. The invention of claim 1 whereby the dimming control means being a separate unit from a ballast or being incorporated into the ballast for fluorescent or HID lamps.

3. The invention of claim 1 whereby the ballast for fluorescent or HID lamps being either an electronic ballast or a magnetic ballast.

4. The invention of claim 1 including a photosensor to determine the amount of light contributed from the sun or other ambient sources at a pre-selected location, said photosensor notifies the device which then automatically reduces the intensity of the light from the lamp.

5. The invention of claim 1 where the reduction of ballast supply voltage results in a proportionately greater amount of reduction in the light intensity of the lamp.

6. The invention of claim 1 where the current is adjusted to vary the light intensity of the lamp.

7. The invention of claim 1 where the light intensity of the lamp being either reduced or increased.

8. The invention of claim 1 comprising the ability of reduction in the light intensity of the lamp in gradual or abrupt steps.

9. The invention of claim 1 further comprising a sensor to determine if any person is in the room whereby the light will remain dimmed while the room is not occupied.

10. The invention of claim 1 where the lamps being either fluorescent lamps or HID lamps.

* * * * *